US009610672B2

(12) United States Patent
Oh et al.

(10) Patent No.: US 9,610,672 B2
(45) Date of Patent: Apr. 4, 2017

(54) CONFIGURABLE PRESSURE DESIGN FOR MULTIZONE CHEMICAL MECHANICAL PLANARIZATION POLISHING HEAD

(71) Applicant: Applied Materials, Inc., Santa Clara, CA (US)

(72) Inventors: Jeonghoon Oh, San Jose, CA (US); Steven M. Zuniga, Soquel, CA (US); Andrew Nagengast, Sunnyvale, CA (US); Samuel Chu-Chiang Hsu, Palo Alto, CA (US); Gautam Shashank Dandavate, Sunnyvale, CA (US)

(73) Assignee: APPLIED MATERIALS, INC., Santa Clara ( * ) Notice: Subject to any disclaimer, the term of this patent is extended or adjusted under 35 U.S.C. 154(b) by 128 days.

(21) Appl. No.: 14/470,852

(22) Filed: Aug. 27, 2014

(65) Prior Publication Data

US 2016/0059377 A1 Mar. 3, 2016

Related U.S. Application Data

(60) Provisional application No. 62/018,286, filed on Jun. 27, 2014.

(51) Int. Cl.
*H01L 21/306* (2006.01)
*B24B 37/10* (2012.01)
(Continued)

(52) U.S. Cl.
CPC ..... *B24B 37/107* (2013.01); *B24B 37/11* (2013.01); *B24B 37/30* (2013.01)

(58) Field of Classification Search
CPC ..... B24B 37/27; B24B 37/11; B24B 37/20; H01L 21/30625; H01L 21/67092; H01L 21/304
(Continued)

(56) References Cited

U.S. PATENT DOCUMENTS 5,605,488 A 2/1997 Ohashi et al.
5,762,539 A 6/1998 Nakashiba et al.
(Continued)

OTHER PUBLICATIONS

PCT Notification of Transmittal of the International Search Report and the Written Opinion of the International Searching Authority for International Application No. PCT/US2015/029034 dated Jul. 31, 2015; 11 total pages.

*Primary Examiner* — Lan Vinh
(74) *Attorney, Agent, or Firm* — Patterson + Sheridan, LLP

(57) ABSTRACT

A polishing head for chemical mechanical planarization is provided. The polishing head includes a housing and a flexible membrane secured to the housing. At least a first, second, and third pressurizable chamber are disposed in the housing and each chamber contacts the flexible membrane. A first pressure delivery channel couples to the first chamber. A second pressure delivery channel couples to the third chamber. A first pressure feed line couples the first pressure delivery channel to the second chamber. A second pressure feed line couples the second pressure delivery channel to the second chamber. A first manually movable plug interfaces with the first pressure feed line to allow or block pressure from the first pressure delivery channel to the second chamber. A second manually movable plug interfaces with the second pressure feed line to allow or block pressure from the first pressure delivery channel to the second chamber.

16 Claims, 5 Drawing Sheets

(51) Int. Cl.
*B24B 37/11* (2012.01)
*B24B 37/30* (2012.01)

(58) Field of Classification Search
USPC ..... 156/345.12, 345.14, 345.23, 345.18; 430/288, 289, 388
See application file for complete search history.

(56) References Cited

U.S. PATENT DOCUMENTS

| | | | | |
|---|---|---|---|---|
| 5,957,751 | A | 9/1999 | Govzman et al. | |
| 6,113,479 | A * | 9/2000 | Sinclair | B24B 37/30 451/288 |
| 6,390,905 | B1 | 5/2002 | Korovin et al. | |
| 6,669,540 | B2 * | 12/2003 | Gripp | B24B 37/30 451/288 |
| 6,764,387 | B1 | 7/2004 | Chen | |
| 6,926,585 | B2 | 8/2005 | Togawa | |
| 7,048,609 | B2 * | 5/2006 | Togawa | B24B 49/16 451/288 |
| 7,207,871 | B1 * | 4/2007 | Zuniga | B24B 49/16 451/288 |
| 8,148,266 | B2 | 4/2012 | Eisenstock et al. | |
| 8,460,067 | B2 | 6/2013 | Chen et al. | |
| 2002/0042246 | A1 | 4/2002 | Togawa et al. | |
| 2003/0186632 | A1 * | 10/2003 | Gripp | B24B 37/30 451/289 |
| 2006/0154580 | A1 | 7/2006 | Chen et al. | |
| 2007/0082589 | A1 | 4/2007 | Zuniga et al. | |
| 2010/0330883 | A1 | 12/2010 | Schwandner | |
| 2013/0273812 | A1 | 10/2013 | Qian et al. | |
| 2014/0138355 | A1 | 5/2014 | Yavelberg | |

* cited by examiner

CONFIGURABLE PRESSURE DESIGN FOR MULTIZONE CHEMICAL MECHANICAL PLANARIZATION POLISHING HEAD

CROSS REFERENCE TO RELATED APPLICATIONS

This application claims benefit of U.S. provisional patent application Ser. No. 62/018,286, filed Jun. 27, 2014, which is herein incorporated by reference.

FIELD

The implementations disclosed relate generally to polishing systems for polishing a substrate, such as a semiconductor substrate. More particularly, implementations relate to configuring pressures supplied by a polishing head of a chemical mechanical planarization system to a substrate during polishing.

BACKGROUND

Chemical mechanical planarization (CMP) is one process commonly used in the manufacture of high-density integrated circuits to planarize or polish a layer of material deposited on a substrate. CMP is effectively employed by providing contact between a feature-containing side of the substrate and a polishing pad by moving the substrate relative to a polishing pad while in the presence of a polishing fluid. Material is removed from the feature-containing side of the substrate that is in contact with the polishing surface through a combination of chemical and mechanical activity. A polishing head is used to apply pressure to the substrate as the substrate is polished. The polishing head is rotated by a drive shaft, which is coupled to a polishing head motor.

Each type of substrate can often require a different pressure profile to best polish the substrate with a polishing head. A polishing head can include multiple pressurizable zones to apply the different pressures on different areas of a given substrate. Each pressurizable zone is coupled to a pressure supply line. The pressure supply lines are routed through a rotary union and a drive shaft to the polishing head. When the process specifies a different pressure profile, the pressure supply lines must often be re-routed to different pressure sources. Re-routing pressure supply lines is time consuming and consequently expensive. Furthermore, the limited space in the polishing head and the drive shaft places a constraint on the number of pressure supply lines that can be coupled to the polishing head. This constraint limits the number of pressurizable zones that can be included in a polishing head as well as the number of pressure profiles that a polishing head can apply.

Therefore, a need exists for an improved polishing system.

SUMMARY

In one implementation, a polishing head for chemical mechanical planarization is provided. The polishing head includes a housing and a flexible membrane. The flexible membrane is secured to the housing. The flexible membrane includes an outer surface to contact a substrate and an inner surface facing an interior of the housing. A plurality of pressurizable chambers is disposed in the housing and contact the inner surface of the flexible membrane. The plurality of pressurizable chambers includes at least a first pressurizable chamber, a second pressurizable chamber, and a third pressurizable chamber. A first pressure delivery channel disposed in the housing is coupled to the first pressurizable chamber. A second pressure delivery channel disposed in the housing is coupled to the third pressurizable chamber. A first pressure feed line disposed in the housing couples the first pressure delivery channel to the second pressurizable chamber. A second pressure feed line disposed in the housing couples the second pressure delivery channel to the second pressurizable chamber. A first manually movable plug is interfaced with the first pressure feed line. The first manually movable plug is operable to fluidly couple the first pressure delivery channel to the second pressurizable chamber when in a first position and to fluidly isolate the first pressure delivery channel from the second pressurizable chamber when in a second position. A second manually movable plug is interfaced with the second pressure feed line. The second manually movable plug is operable to fluidly couple the second pressure delivery channel to the second pressurizable chamber when in a first position and to fluidly isolate the second pressure delivery channel from the second pressurizable chamber when in a second position.

In another implementation, a polishing system for chemical mechanical planarization is provided. The polishing system includes a polishing assembly, a plurality of pressure sources and a pressure switching assembly. The polishing assembly includes a rotatable shaft, a rotary union, a polishing head, and a plurality of pressure delivery channels. The rotatable shaft has a first end and a second end. The rotary union is coupled to the rotatable shaft proximate the first end of the rotatable shaft. The polishing head is coupled to the second end of the rotatable shaft. The polishing head is rotatable by rotation of the shaft. The polishing head includes a housing, a flexible membrane to contact a substrate, and a plurality of pressurizable chambers. The flexible membrane is secured to the housing. The plurality of pressurizable chambers are disposed within the housing and each chamber contacts the flexible membrane. The plurality of pressure delivery channels are distributed through the shaft from the first end to the second end and into the polishing head. Each pressure delivery channel couples the rotary union to one pressurizable chamber. The pressure switching assembly includes an input connected to the two or more pressure sources and an output coupled to the rotary union. The pressure switching assembly is operable to couple a first pressure source of the plurality of pressure sources to a first pressure delivery channel and a second pressure source of the plurality of pressure sources to a second pressure delivery channel when in a first state. The pressure switching assembly is further operable to couple the second pressure source to the first pressure delivery channel and the first pressure source to the second pressure delivery channel when in a second state.

In another implementation, a method of polishing a substrate with a polishing head is provided. The polishing head includes a housing; a flexible membrane secured to the housing, the flexible membrane including an outer surface to contact the substrate and a inner surface facing an interior of the housing; a plurality of pressurizable chambers comprising two or more single-pressure chambers and one or more dual-pressure chambers, the plurality of pressurizable chambers disposed in the housing and contacting the inner surface of the flexible membrane; a plurality of pressure feed lines, each pressure feed line coupling one dual-pressure chamber to one single-pressure chamber; and a manually movable plug disposed in each of the pressure feed lines. The method includes securing a first substrate to the flexible membrane of the polishing head; polishing the first substrate secured in the polishing head; exerting a first pressure profile on the first substrate by pressurizing the plurality of pressurizable chambers within the polishing head; removing the first substrate from the polishing head; changing a position of at least two plugs disposed in the polishing head to enable a second pressure profile to be imparted on the flexible membrane; securing a second substrate to the flexible membrane of the polishing head; and polishing the second substrate secured in the polishing head while exerting the second pressure profile on the second substrate.

BRIEF DESCRIPTION OF THE DRAWINGS

So that the manner in which the above recited features of the implementations disclosed above can be understood in detail, a more particular description, briefly summarized above, may be had by reference to the following implementations, some of which are illustrated in the appended drawings. It is to be noted, however, that the appended drawings illustrate only typical implementations and are therefore not to be considered limiting of its scope to exclude other equally effective implementations.

Figure 1:
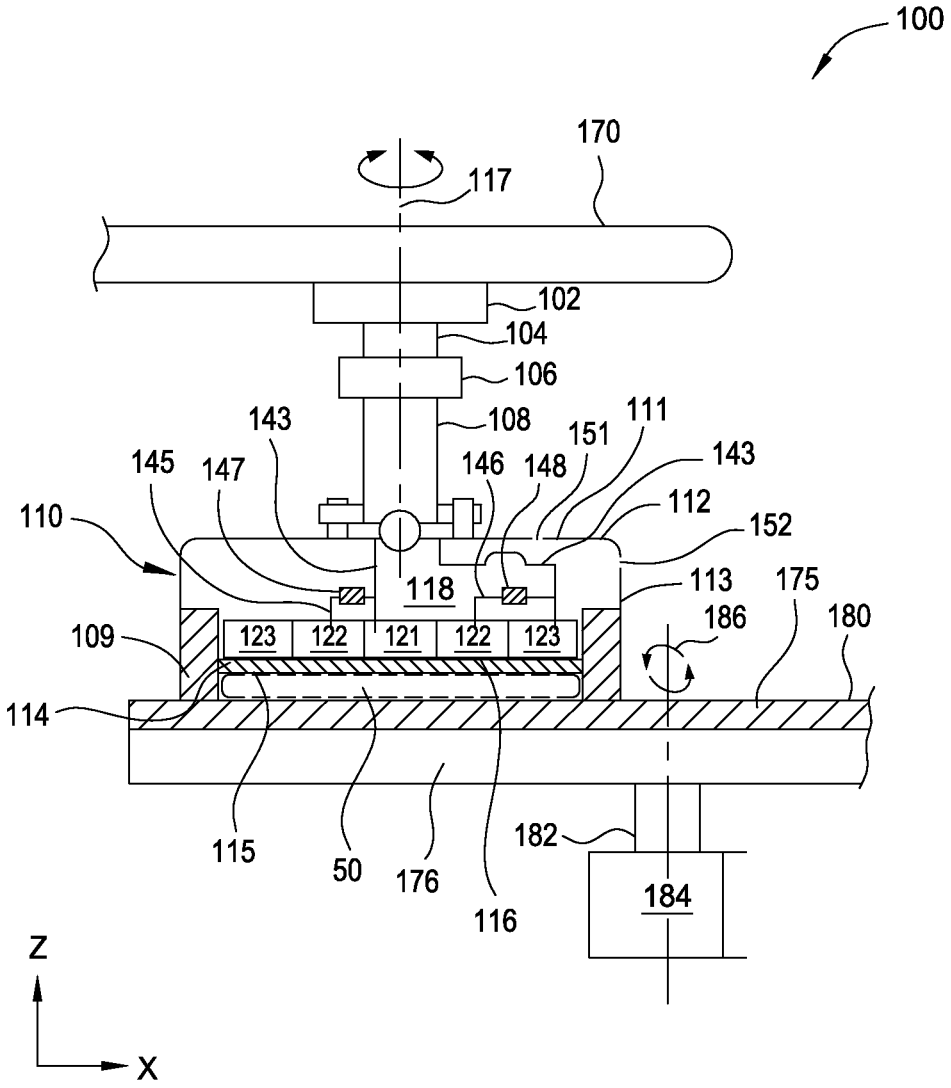
FIG. 1 is a side cross-sectional view of a CMP system, according to one implementation.

To facilitate understanding, identical reference numerals have been used, where possible, to designate identical elements that are common to the figures. It is contemplated that elements disclosed in one implementation may be beneficially utilized on other implementations without specific recitation.

DETAILED DESCRIPTION

The implementations disclosed relate generally to polishing systems for polishing a substrate, such as a semiconductor substrate, for example using CMP. Each type of substrate can often specify a different pressure profile to best polish the substrate with a polishing head. The implementations disclosed allow the pressure profile applied across the polishing head to the surface of a substrate during polishing to be quickly adjusted, which can reduce equipment downtime. The implementations disclosed can also improve product quality by enabling use of additional pressure profiles that may more closely match the pressure profile best suited to polish each substrate. Examples of a polishing head that may be adapted to benefit from the implementations disclosed include the TITAN HEAD™, the TITAN CONTOUR™, and the TITAN PROFILER™ polishing heads, which are available from Applied Materials, Inc. of Santa Clara, Calif., among others.

FIG. 1 is a side cross-sectional view of a CMP system 100, according to one implementation. A polishing head 110 holds a substrate 50 (shown in phantom) in contact with a polishing surface 180 of a polishing pad 175. The polishing pad 175 is disposed on a platen 176. The platen 176 is coupled to a motor 184 by a platen shaft 182. The motor 184 rotates the platen 176 and hence, polishing surface 180 of the polishing pad 175, about an axis 186 of the platen shaft 182 when the CMP system 100 is polishing the substrate 50.

The polishing head 110 is coupled to a shaft 108, which is coupled to a motor 102, which is in turn coupled to an arm 170. The motor 102 moves the polishing head 110 laterally in a linear motion (X and/or Y direction) relative to the arm 170. The polishing head 110 also includes an actuator or motor 104 to move the polishing head 110 in the Z direction relative to arm 170 and/or the polishing pad 175. The polishing head 110 is also coupled to a rotary actuator or motor 106 that rotates the polishing head 110 about a rotational axis 117 relative to the arm 170. The motors 104, 102, and 106 position and/or move the polishing head 110 relative to the polishing surface 180 of the polishing pad 175. The motors 104 and 106 rotate the polishing head 110 relative to the polishing surface 180 and provide a downward force to urge the substrate 50 against the polishing surface 180 of the polishing pad 175 during processing.

The polishing head 110 includes a housing 112 circumscribed by a retaining ring 109. A flexible membrane 114 is secured to the housing 112. The flexible membrane 114 includes an outer surface 115 to contact the substrate 50 and an inner surface 116 facing an interior 118 of the housing 112. A plurality of pressurizable chambers including at least a first pressurizable chamber 121, a second pressurizable chamber 122, and a third pressurizable chamber 123 are disposed in the housing 112. Each pressurizable chamber 121, 122, 123 contacts the inner surface 116 of the flexible membrane 114 and is capable of exerting a pressure on the inner surface 116. The pressurizable chambers 121-123 are concentrically arranged around the center of the flexible membrane 114. The innermost pressurizable chamber (i.e., pressurizable chamber 121) contacts a circular area of the inner surface 116 of the flexible membrane 114 while the other pressurizable chambers 122, 123 contact annular areas of the inner surface 116 of the flexible membrane 114. In other implementations, different geometric arrangements of the pressurizable chambers relative to the flexible membrane 114 could be used.

A first pressure delivery channel 143 is disposed in the housing 112 and coupled to the first pressurizable chamber 121. A second pressure delivery channel 144 is disposed in the housing 112 and is coupled to the third pressurizable chamber 123. Each pressure delivery channel 143, 144 can be coupled to a separate pressure source, such as a separate supplies of compressed gas or other pressurized fluids. The pressure delivery channels 143, 144 can be coupled to the pressure sources by connecting the pressure delivery channels to pressure supply lines distributed through the shaft 108. The pressure supply lines could be routed through a rotary union to maintain the connection to the pressure sources as the shaft 108 and the housing 112 rotates.

A first pressure feed line 145 is disposed in the housing 112 and couples the first pressure delivery channel 143 to the second pressurizable chamber 122. A second pressure feed line 146 is disposed in the housing 112 and couples the second pressure delivery channel 144 to the second pressurizable chamber 122. Thus, the second pressurizable chamber 122 can be pressurized by fluid provided through either pressure delivery channel 143, 144.

A first manually movable plug 147 may be interfaced with the first pressure feed line 145. The first manually movable plug 147 is operable to fluidly couple the first pressure delivery channel 143 to the second pressurizable chamber 122 when in a first position (see FIG. 2B) and to fluidly isolate the first pressure delivery channel 143 from the second pressurizable chamber 122 when in a second position (see FIG. 2C). A second manually movable plug 148 can be interfaced with the second pressure feed line 146. The second manually movable plug 148 is operable to fluidly couple the second pressure delivery channel 144 to the second pressurizable chamber 122 when in a first position (see FIG. 2B) and to fluidly isolate the second pressure delivery channel 144 from the second pressurizable chamber 122 when in a second position (see FIG. 2C). The polishing head 110 can include one or more openings 151 through a top 111 of the housing 112 or one or more openings 152 through a side 113 of the housing 112 to enable adjustment of each manually movable plug 147, 148. In some implementations, a separate opening (e.g., opening 151) through the housing 112 is used for each manually movable plug (e.g., plug 147), where each opening enables adjustment of a separate manually movable plug. In other implementations, one opening allows access to adjust multiple plugs. In another implementation, a portion of each plug extends through the housing 112 to enable position adjustment of the plugs.

In the following description, a subscript "n" denotes the last element in a group of elements, where "n" is a defined integer (e.g., "n"=10) or a defined range of integers (e.g., "n" is between five and ten). A subscript "i" denotes an individual, but non-specific element of the group of elements, where "i" can hold any value between 1 and "n." For example, for a group of ten chambers, where all the chambers use the reference number 50, a chamber $\mathbf{50}_i$ refers to any chamber between chamber 1 and chamber 10 and chamber $\mathbf{50}_n$ refers to the $10^{th}$ chamber. Elements with the subscript "i" are not shown in the Figures. A subscript "iA" and a subscript "iB" refer to a first sub-element and a second sub-element, respectively, connected to or related to an $i^{th}$ element. For example, a motor $\mathbf{75}_{1A}$ and a motor $\mathbf{75}_{1B}$ can refer to a first and second motor connected to or related to a first chamber $\mathbf{50}_1$.

Figure 2A:
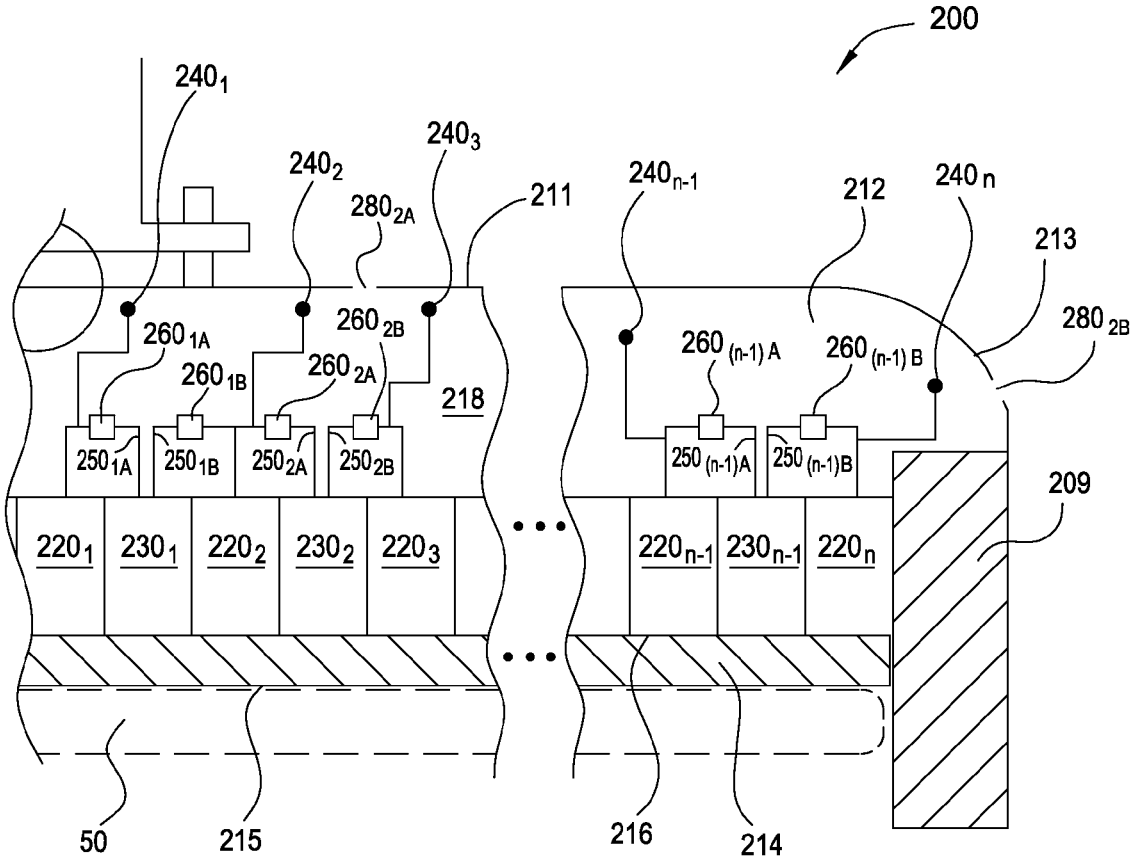
FIG. 2A is a partial side cross-sectional view of a polishing head, according to one implementation.

FIG. 2A is a partial side cross-sectional view of a polishing head 210, according to one implementation. The polishing head 210 may be used in the CMP system 100 or other polishing systems. Polishing head 210 includes a housing 212 circumscribed by a retaining ring 209 that is used to retain a substrate 50 within the polishing head 210. A flexible membrane 214 is secured to the housing 212. The flexible membrane 214 includes an outer surface 215 to contact the substrate 50 and an inner surface 216 facing an interior 218 of the housing 212. A plurality of pressurizable chambers $\mathbf{220}_1$-$\mathbf{220}_n$ and $\mathbf{230}_1$-$\mathbf{230}_{n-1}$ are disposed in the housing 212. Each pressurizable chamber $\mathbf{220}_i$ and $\mathbf{230}_i$ contacts the inner surface 216 of the flexible membrane 214. The innermost pressurizable chamber (i.e., pressurizable chamber $\mathbf{220}_1$) may contact a circular, disk, or annular area of the inner surface 216 of the flexible membrane 214 while the other pressurizable chambers $\mathbf{220}_2$-$\mathbf{220}_n$, $\mathbf{230}_1$-$\mathbf{230}_{n-1}$ may be concentric with chamber $\mathbf{220}_1$ and may contact annular areas of the inner surface 216 of the flexible membrane 214. In other implementations, different geometric arrangements of the pressurizable chambers relative to the flexible membrane 214 could be used.

Polishing head 210 may include more pressurizable chambers (e.g., pressurizable chamber $\mathbf{220}_i$ and $\mathbf{230}_i$) compared to polishing head 110. Polishing head 210 includes "n" single-pressure chambers $\mathbf{220}_i$. In some implementations, n is an integer between two and twenty. In other implementations, n could include different ranges of integers. Each single-pressure chamber $\mathbf{220}_i$ is coupled to a separate pressure delivery channel $\mathbf{240}_i$. Each pressure delivery channel $\mathbf{240}_i$ could be routed out the polishing head 210 and up the polishing head shaft 208 to a separate pressure source, which as discussed above could be a supply of compressed air or other pressurized fluid. In some implementations, the pressure delivery channel couples with another line or channel in the polishing head 210 or the shaft 208, and the other line or channel is then coupled to the pressure source. Each pressure deliver channel $\mathbf{240}_i$ is shown terminating inside the polishing head to maintain clarity in the drawing, but each pressure delivery channel $\mathbf{240}_i$ has at least a connection for another line or channel that would be distributed through the shaft 208. Polishing head 210 also includes "n−1" dual-pressure chambers $\mathbf{230}_i$, where "n" is again an integer between two and twenty. Each dual-pressure chamber $\mathbf{230}_i$ is separately coupled to two pressure delivery channels $\mathbf{240}_i$, $\mathbf{240}_{i+1}$, through two separate pressure feed lines $\mathbf{250}_{i\ (A,\ B)}$.

A manually movable plug $\mathbf{260}_{i\ (A,B)}$ can be interfaced with each pressure feed line $\mathbf{250}_{i\ (A,\ B)}$. Each manually movable plug $\mathbf{260}_{i\ (A)}$ can be set to an opened first position 261 (see FIG. 2B) to fluidly couple a dual-pressure chamber $\mathbf{230}_i$ to a pressure delivery channel $\mathbf{240}_i$, or each manually movable plug $\mathbf{260}_{i\ (A)}$ can be set to a closed second position 262 (see FIG. 2C) to fluidly isolate the dual-pressure chamber $\mathbf{230}_i$ from the pressure delivery channel $\mathbf{240}_i$. Each manually movable plug $\mathbf{260}_{i\ (B)}$ can be set to an opened first position 261 (see FIG. 2B) to fluidly couple a dual-pressure chamber $\mathbf{230}_i$ to a pressure delivery channel $\mathbf{240}_{i+1}$, or each manually movable plug $\mathbf{260}_{i\ (B)}$ can be set to a closed second position 262 (see FIG. 2C) to fluidly isolate the dual-pressure chamber $\mathbf{230}_i$ from the pressure delivery channel $\mathbf{240}_{i+1}$. The polishing head 210 could include an opening $\mathbf{280}_{i(A,B)}$ through a top 211 or a side 213 of the housing to enable adjustment of each manually movable plug $\mathbf{260}_{i(A,B)}$. Only two openings $\mathbf{280}_{2A}$ and $\mathbf{280}_{2B}$ are displayed in the Figure to maintain clarity, but there could be a separate opening for each plug $\mathbf{260}_{i(A,B)}$. In some implementations, there could be one opening for more than one plug or one opening for all of the plugs. In some implementations, the openings can be closed or sealed when the position of the plugs are not being changed.

In some implementations, a dual-pressure chamber $\mathbf{230}_i$ is adjacent to each single-pressure chamber $\mathbf{220}_i$. In some of those implementations, a dual-pressure chamber $\mathbf{230}_i$ is adjacent to each single-pressure chamber $\mathbf{220}_i$ on either side of each single-pressure chamber $\mathbf{220}_i$ except the single-pressure chambers at the center and perimeter of the housing 212, such as single-pressure chambers $\mathbf{220}_1$ and $\mathbf{220}_n$. In other implementations, there could be multiple single-pressure chambers $\mathbf{220}_i$ adjacent to each other. In other implementations, there could be multiple dual-pressure chambers $\mathbf{230}_i$ adjacent to each other.

Figure 2B:
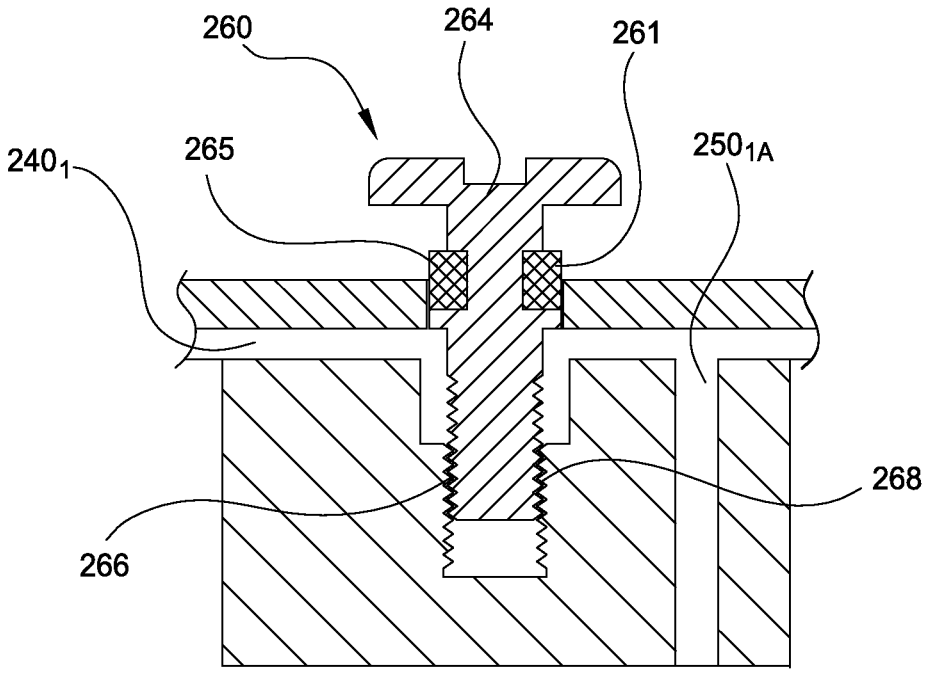
FIG. 2B is a side cross-sectional view of a plug in a polishing head, according to one implementation.
Figure 2C:
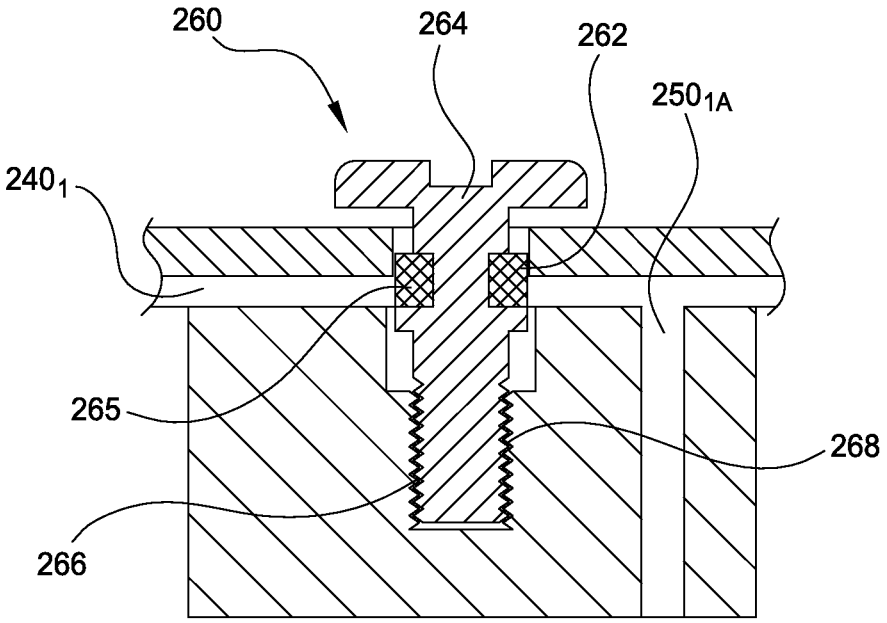
FIG. 2C is a side cross-sectional view of a plug in a polishing head, according to one implementation.
Figure 3:
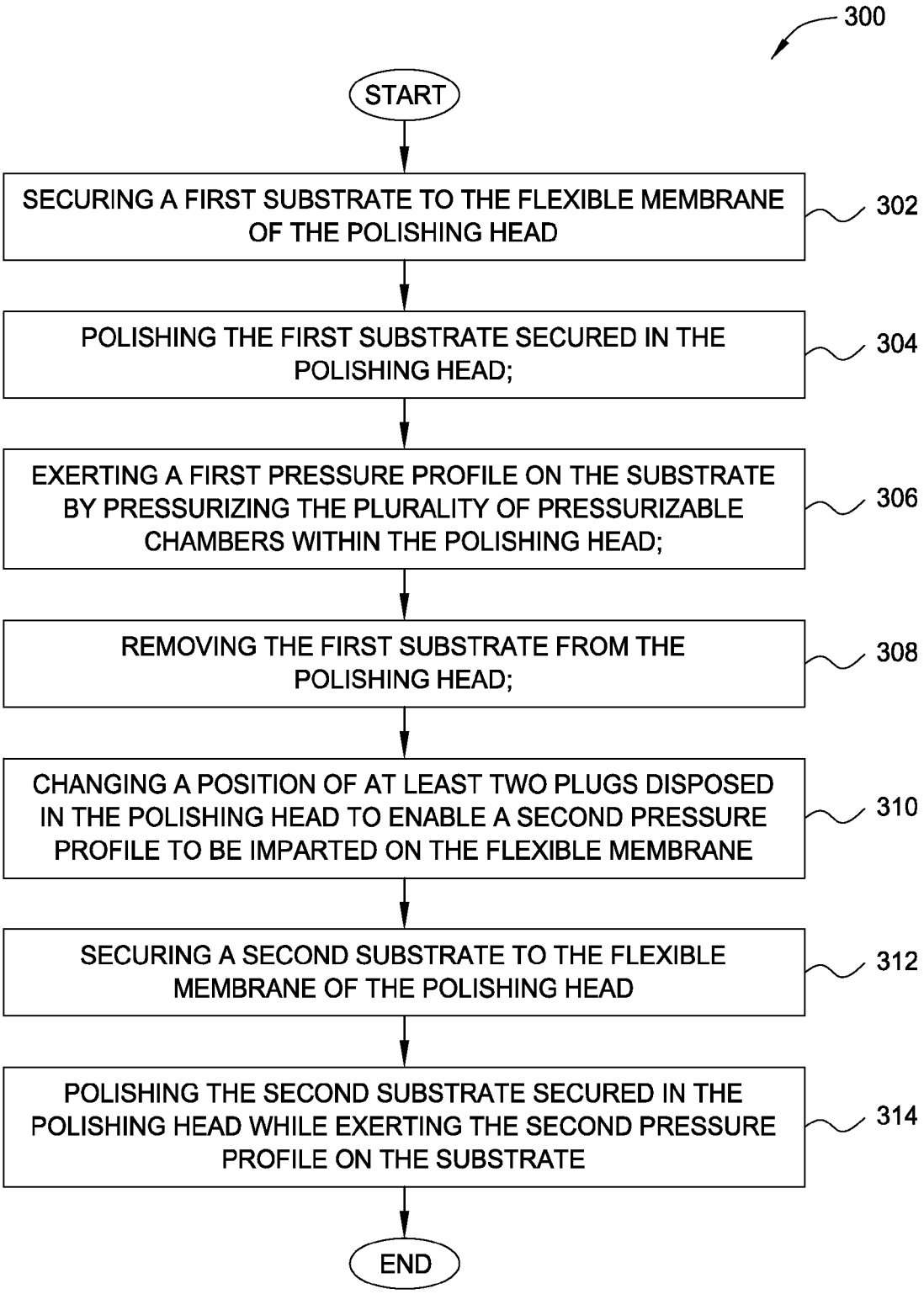
FIG. 3 is a process flow diagram, according to one implementation.

FIGS. 2B and 2C are enlarged cross-sectional views of the plug $\mathbf{260}_{1A}$ of FIG. 2A in an opened and closed position respectively, according to one implementation. The plugs 147, 148 in polishing head 110 of FIG. 1 as wells as the remainder of the plugs $\mathbf{260}_{i(A,B)}$ in polishing head 210 could be the same or have similar features as the plug $\mathbf{260}_{1A}$. Plug $\mathbf{260}_{1A}$ includes a fastener 264 having threads 266 to interface with a threaded connection 268. Plug $\mathbf{260}_{1A}$ also includes a sealing member 265 to create a seal between the pressure delivery channel $\mathbf{240}_1$ and the pressure feed line $\mathbf{250}_{1A}$, which is one of the two pressure feed lines $\mathbf{250}_{1(A,B)}$ feeding dual-pressure chamber $\mathbf{230}_1$. One or more other sealing members (not shown) could also be included with plug $\mathbf{260}_{1A}$, so that pressurized fluid in the pressure delivery channel $\mathbf{240}_1$ or the pressure feed line $\mathbf{250}_{1A}$ does not leak around the plug $\mathbf{260}_{1A}$.

FIG. 2B illustrates the plug $260_{1A}$ in an opened first position 261. In the opened first position 261, the sealing member 265 is removed from the pressure delivery channel $240_1$ and fluid from a pressure source can flow around the parts of the fastener 264 remaining in the pressure delivery channel $240_1$ to pressurize the dual-pressure chamber $230_1$. FIG. 2C illustrates the plug $260_{1A}$ in a closed second position 262. In the closed second position 262, the sealing member 265 is placed into the pressure delivery channel $240_1$ to sealingly block the pressurized fluid in the pressure delivery channel $240_1$ from reaching the dual-pressure chamber $230_1$.

The threaded connection 268 could be part of the polishing head housing or another component on or in the polishing head housing. The threaded connection 268 that engages the plug $260_{1A}$ is shown below the pressure delivery channel $240_1$ in FIGS. 2B and 2C, but threaded connection 268 could be placed in other locations in different implementations. In one implementation of a plug having a threaded member, the threaded member could interface with a threaded connection located above the pressure delivery channel and a sealing plunger connected to an end of the fastener could extend down through the pressure delivery channel to block the pressurized fluid when the plug is closed. Having the threaded connection above the pressure delivery channel could allow the plug to be completely removed from the pressure delivery channel so that there are no obstructions to the fluid flow when the plug is in the opened position. In some implementations, the entire plug $260_1$ is located inside the polishing head housing. In other implementations portions of the plug can extend through the polishing head housing.

Using a plug, such as plug $260_{1A}$, provides numerous advantages. Because plug $260_{1A}$ only includes a few components, such as the fastener 264 and the sealing member 265, the plug $260_{1A}$ has a small footprint only occupying a small amount of space in the polishing head. This small footprint allows for multiple plugs and other control features to be placed in the polishing head. On the other hand, there may not be enough room for larger flow control or electronic devices in the limited space that exists inside polishing heads. Also, changing the position of the plug can be done quickly and relatively easily by use of common manual tools, such as a screw driver or hex key. Making the position changes of the plugs a manual operation removes the need for any additional components or wiring that would be needed if any automatic or electronic control of the pressure within each chamber in the polishing head was utilized. Finally, components such as threaded fasteners and sealing members are relatively inexpensive and thus should add little to the overall material costs of a polishing head.

Referring to FIGS. 2A-2C and 3, a method 300 is described for polishing a substrate with a polishing head. Although the method is described in conjunction with reference to the systems of FIGS. 2A-2C, persons skilled in the art would understand that any suitably adapted polishing head configured to perform the method steps, in any order, is within the scope of the implementations disclosed. Method 300 could be executed on polishing head 210.

At block 302, a first substrate, such as substrate 50, is secured to the flexible membrane 214 of the polishing head 210. At block 304, the first substrate that is secured in the polishing head 210 is polished. At block 306, a first pressure profile is exerted on the first substrate by pressurizing the plurality of pressurizable chambers $220_1$-$220_n$ and $230_1$-$230_{n-1}$ within the polishing head 210 while the substrate is polished. At block 308, the first substrate is removed from the polishing head 210.

At block 310, positions of at least two plugs $260_{i(A,B)}$ disposed in the polishing head are changed to enable a second pressure profile to be imparted on the flexible membrane 214. For example, to change from a first pressure profile to the a second pressure profile, the plug $260_{1A}$ could be changed from an opened first position 261 to a closed second position 262, and the plug $260_{1B}$ could be changed from a closed second position 262 to an opened first position 261. In the first pressure profile, the pressure in dual-pressure chamber $230_1$ matches the pressure in single pressure chamber $220_1$, and in the second pressure profile, the pressure in dual-pressure chamber $230_1$ matches the pressure in single-pressure chamber $220_2$. When switching pressure profiles, the position of two, more than two, or all of the plugs $260_{i(A,B)}$ could be changed. The pressure profiles could have increasing or decreasing pressures from the center to the edge of the substrate being processed. For some pressure profiles the pressure could alternate between increasing and decreasing pressures from the center to the edge of the substrate.

The position of the plugs $260_{i(A,B)}$ could be changed by inserting a tool, such as a screw driver, through one or more openings $280_{i(A,B)}$ in a top 211 or a side 213 of the housing 212. At least one of the openings $280_{i(A,B)}$ can be aligned with a first plug $260_{1A}$ Changing the position of the first plug $260_{1A}$ could further include rotating the tool to move the first plug $260_{1A}$ from an opened first position 261 to a closed second position 262. The opened first position 261 is operable to fluidly couple a first dual-pressure chamber $230_1$ to a first single-pressure chamber $220_1$ and the closed second position 262 is operable to fluidly isolate the first dual-pressure chamber $230_1$ from the first single-pressure chamber $220_1$. Changing the position of the remainder of the plugs $260_{i(A,B)}$ could function the same or similarly to the changing of the position of the plug $260_{1A}$.

At block 312, a second substrate is secured to the flexible membrane 214 of the polishing head 210. At block 314, the second substrate secured in the polishing head 210 is polished while exerting the second pressure profile on the second substrate.

Figure 4:
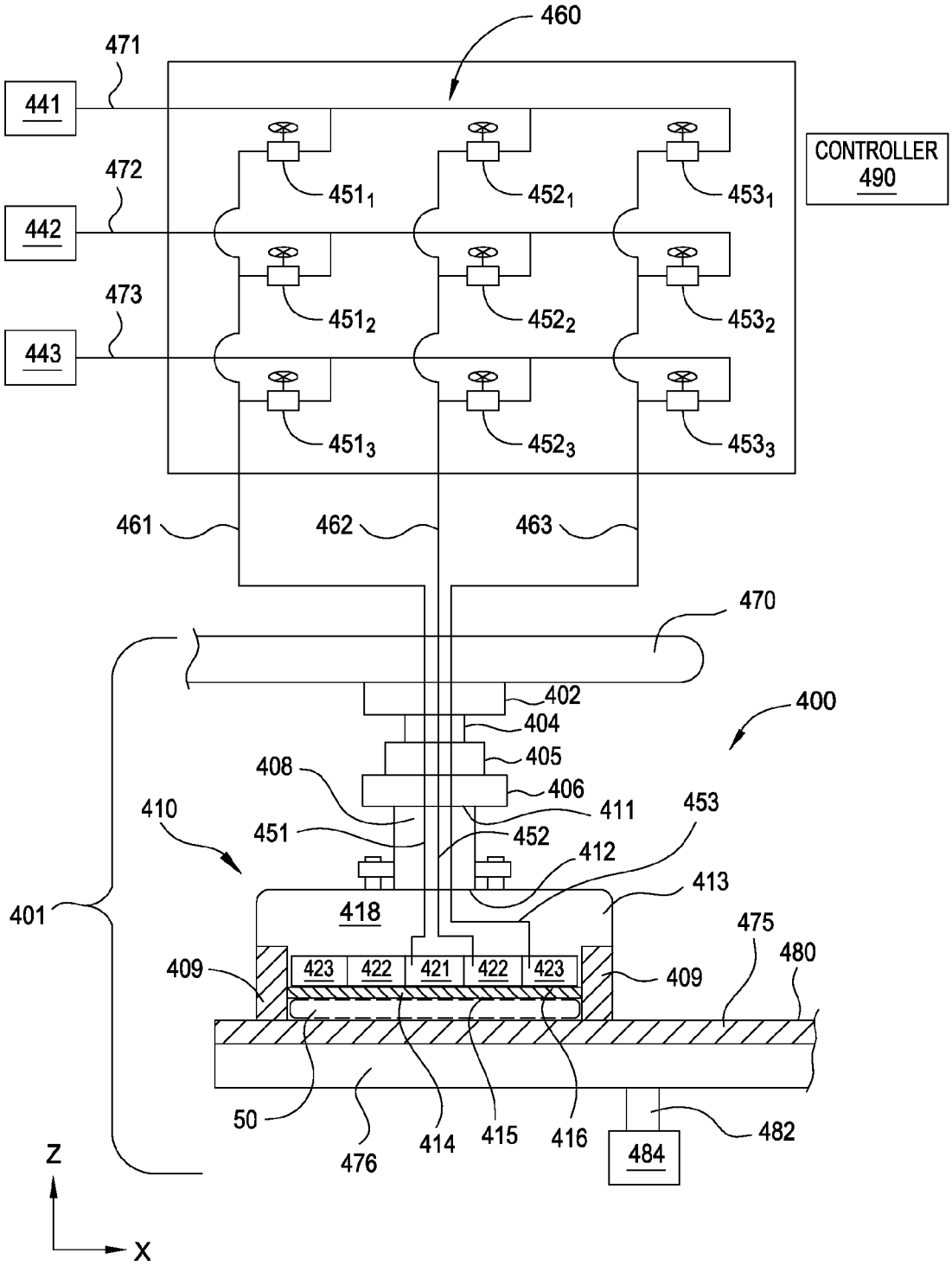
FIG. 4 is a side sectional view of a CMP system, according to another implementation.

FIG. 4 is a side sectional view of a CMP system 400, according to another implementation. CMP system 400 is similar to CMP system 100 having many of the same features and components. CMP system 400 does not include any dual-pressure chambers, such as second pressurizable chamber 122 of CMP system 100. CMP system 400 also does not include any internal plugs, such as plugs 147, 148 of CMP system 100.

The CMP system 400 includes a polishing assembly 401. The polishing assembly 401 can include a polishing head 410 and a polishing pad 475. The polishing head 410 holds a substrate 50 (shown in phantom) in contact with a polishing surface 480 of the polishing pad 475. The polishing pad 475 is disposed on a platen 476. The platen 476 is coupled to a motor 484 by a platen shaft 482. The motor 484 rotates the platen 476 and hence, polishing surface 480 of the polishing pad 475, about an axis of the platen shaft 482 when the CMP system 400 is polishing the substrate 50.

The polishing head 410 includes a housing 413 circumscribed by a retaining ring 409. A flexible membrane 414 is secured to the housing 413. The flexible membrane 414 includes an outer surface 415 to contact the substrate 50 and an inner surface 416 facing an interior 418 of the housing 413. A plurality of pressurizable chambers 421, 422, 423 are disposed in the housing 413. Each pressurizable chamber 421, 422, 423 contacts the inner surface 416 of the flexible membrane 414. The plurality of pressurizable chambers includes at least a first pressurizable chamber 421, a second pressurizable chamber 422, and a third pressurizable chamber 423. The pressurizable chambers 421-423 are concentrically arranged around the center-line of the flexible membrane 414. The innermost pressurizable chamber (i.e., pressurizable chamber 421) contacts a circular area of the inner surface 416 of the flexible membrane 414 while the other pressurizable chambers 422, 423 contact annular areas of the inner surface 416 of the flexible membrane 414. In other implementations, different geometric arrangements of the pressurizable chambers relative to the flexible membrane 414 could be used.

The polishing assembly 401 further includes a rotary union 405 and a rotatable shaft 408 having a first end 411 and a second end 412. The rotary union 405 is coupled to the rotatable shaft 408 proximate the first end 411 of the rotatable shaft 408. The rotary union 405 permits fluid flow to pressurize the pressurizable chambers 421-423 while the shaft 408 rotates. The polishing head 410 is coupled to the second end 412 of the rotatable shaft 408. The polishing head 410 is rotatable by rotation of the shaft 408. A rotary actuator or motor 406 is coupled to the rotatable shaft 408 proximate the first end 411. The motor 406 rotates the polishing head 410 about a rotational axis relative to the polishing surface 480 of the polishing pad 475. A plurality of pressure delivery channels 451-453 are distributed through the rotatable shaft 408 from the first end 411 to the second end 412 and into the polishing head 410. Each pressure delivery channel 451-453 couples the rotary union 405 to one of the pressurizable chambers 421-423. In some implementations, the polishing assembly 401 could include between three and ten pressurizable chambers and between three and ten pressure delivery channels, but other implementations could include as few as two or greater than ten pressurizable chambers or pressure delivery channels.

Proximate the first end 411 of the rotatable shaft 408, the shaft 408 is also coupled to a motor 402, which is in turn coupled to an arm 470. The motor 402 moves the polishing head 410 laterally in a linear motion (X and/or Y direction) relative to the arm 470. The polishing assembly 401 also includes an actuator or motor 404 to move the polishing head 410 in the Z direction relative to the arm 470 and/or the polishing pad 475. The motors 404, 402, and 406 position and/or move the polishing head 410 relative to the polishing surface 480 of the polishing pad 475. The motors 404 and 406 rotate the polishing head 410 relative to the polishing surface 480 and provide a downward force to urge the substrate 50 against the polishing surface 480 of the polishing pad 475 during processing.

The CMP system 400 also includes three pressure sources 441, 442, and 443. Each pressure source 441-443 can provides a different pressure to the pressurizable chambers 421-423 of the polishing head 410. CMP system 400 includes three pressure sources 441-443, but other implementations could include two pressure sources or greater than three pressure sources. In one implementation, the pressure sources 441-443 include compressed air, but other pressurized fluids could be used.

The CMP system 400 also includes a pressure switching assembly 460. The pressure switching assembly 460 is operable to switch the pressures applied to the pressurizable chambers 421-423 in the polishing head 410. The pressure switching assembly includes inputs 471, 472, 473 coupled to the plurality of pressure sources 441-443 and outputs 461, 462, 463 coupled to the pressure delivery channels 451, 452, 452 respectively through the rotary union 405. In some implementations, there is an output line (e.g., output 461) from pressure switching assembly 460 to the rotary union 405 for each pressurizable chamber 421-423. The pressure switching assembly 460 includes nine valves $\mathbf{451}_1$-$\mathbf{451}_3$, $\mathbf{452}_1$-$\mathbf{452}_3$, and $\mathbf{453}_1$-$\mathbf{453}_3$. Each group of valves (e.g., valves $\mathbf{451}_1$-$\mathbf{451}_3$) can be used to couple any of the pressure sources 441-443 to one of the pressure delivery channels (e.g., pressure delivery channel 451) and ultimately to one of the pressurizable chambers (e.g., pressurizable chamber 421). In one implementation, the set of valves includes a number of valves equal to a product of a number of pressure sources multiplied by a number of pressurizable chambers to enable each pressure source to be applied to each pressurizable chamber and for each pressurizable chamber to be pressurized with a different pressure source. In some implementations, there could be more pressurizable chambers than pressure sources or there could be more pressure sources than pressurizable chambers.

The pressure switching assembly 460 is operable to couple the first pressure source 441 of the plurality of pressure sources 441-443 to the first pressure delivery channel 451 and the second pressure source 442 of the plurality of pressure sources 441-443 to a second pressure delivery channel 452 when in a first state. The first state could be represented by valves $\mathbf{451}_1$ and $\mathbf{452}_2$ being opened and valves $\mathbf{451}_2$, $\mathbf{451}_3$ and $\mathbf{452}_1$, $\mathbf{452}_3$ being closed. The pressure switching assembly 460 is also operable to couple the second pressure source 442 to the first pressure delivery channel 451 and the first pressure source 441 to the second pressure delivery channel 452 when in a second state. The second state could be represented by valves $\mathbf{451}_2$ and $\mathbf{452}_1$ being opened and valves $\mathbf{451}_1$, $\mathbf{451}_3$ and $\mathbf{452}_2$ and $\mathbf{452}_3$ being closed.

In one implementation, the pressure switching assembly includes a set of automatic valves coupled to a controller 490 to allow electronic control of the valves. The controller 490 could automatically switch the positions of the valves based on the type of substrate being polished.

The CMP implementations described herein illustrate how a pressure profile applied across different areas of a polishing head can be quickly adjusted, which reduces equipment downtime and increases the types of substrates that can be processed with a given polishing head. Referring to FIG. 2A, polishing head 210 reduces downtime by allowing for the pressure applied to the dual-pressure chambers $\mathbf{230}_i$ to be quickly switched by changing the position of the plugs $\mathbf{260}_{i(A,B)}$ in the channels coupled to the chamber. Referring to FIG. 4, CMP system 400 reduces downtime by allowing for the pressure supplied to one or more of the pressure delivery channels 451-453 to be quickly switched through use of the pressure switching assembly 460.

Polishing head 110 and 210 can also improve product quality by allowing for additional pressure profiles to be explored. As described above, the limited space in the polishing head and the rotatable shaft places a constraint on the number of pressure delivery channels that can be coupled to the polishing head. This constraint limits the number of pressurizable zones that can be included in a polishing head when each pressurizable chamber is coupled to only one pressure delivery channel. The dual-pressure chambers in polishing head 110 and 210 are each coupled to two pressure delivery channels through two pressure feed lines allowing the pressure supplied to each dual-pressure chamber to be quickly switched between two pressure sources without adding any additional channels or supply lines to the rotatable shaft. Each dual-pressure chamber allows for an additional pressure profile to be explored between the two neighboring single-pressure chambers. Moreover, the combinations that can be created by the addition of a plurality of dual-pressure chambers in one polishing head allows for even more pressure profiles to be explored across the surface of a substrate. With more pressure profiles available, a more tailored profile can be fit to each substrate, which improves product quality.

Pressure switching assembly 460 also allows the pressure in the polishing head to be quickly switched without adding any moving or electronic parts to the polishing head. Placing the pressure switching assembly outside of polishing head also allows for easier maintenance and servicing because there is no problem associated with limited space as there is when a pressure switching device is placed inside the polishing head. Pressure switching assembly enables the pressure supplied to the different pressurizable chambers in the polishing head to be adjusted remotely, even during polishing. Additionally, keeping the pressure switching assembly remote from the polishing head allows for pressure adjustments without any contact to the polishing head, reducing the risk of damaging the polishing head or introducing any contaminants into the polishing head.

While the foregoing is directed to typical implementations, other and further implementations may be devised without departing from the basic scope thereof, and the scope thereof is determined by the claims that follow.

What is claimed is:

1. A polishing head for chemical mechanical planarization comprising:

a housing;

a flexible membrane secured to the housing, the flexible membrane comprising an outer surface to contact a substrate and an inner surface facing an interior of the housing;

a plurality of pressurizable chambers disposed in the housing and contacting the inner surface of the flexible membrane, the plurality of pressurizable chambers including at least a first pressurizable chamber, a second pressurizable chamber and a third pressurizable chamber;

a first pressure delivery channel disposed in the housing and coupled to the first pressurizable chamber;

a second pressure delivery channel disposed in the housing and coupled to the third pressurizable chamber;

a first pressure feed line disposed in the housing and coupling the first pressure delivery channel to the second pressurizable chamber;

a second pressure feed line disposed in the housing and coupling the second pressure delivery channel to the second pressurizable chamber;

a first manually movable plug interfaced with the first pressure feed line, the first manually movable plug operable to fluidly couple the first pressure delivery channel to the second pressurizable chamber when in a first position and to fluidly isolate the first pressure delivery channel from the second pressurizable chamber when in a second position;

an opening through the housing to enable adjustment of the first manually movable plug; and a second manually movable plug interfaced with the second pressure feed line, the second manually movable plug operable to fluidly couple the second pressure delivery channel to the second pressurizable chamber when in a first position and to fluidly isolate the second pressure delivery channel from the second pressurizable chamber when in a second position.

2. The polishing head of claim 1, wherein the opening is through a top of the housing.

3. The polishing head of claim 1, wherein the opening is through a side of the housing.

4. A polishing system for chemical mechanical planarization comprising:

a polishing assembly comprising:

a rotatable shaft having a first end and a second end;

a rotary union coupled to the rotatable shaft proximate the first end of the rotatable shaft;

a polishing head coupled to the second end of the rotatable shaft, the polishing head rotatable by rotation of the shaft, the polishing head comprising a housing;

a flexible membrane to contact a substrate, the flexible membrane secured to the housing; and a plurality of pressurizable chambers within the housing and contacting the flexible membrane;

a plurality of pressure delivery channels distributed through the shaft from the first end to the second end and into the polishing head, each pressure delivery channel coupling the rotary union to one pressurizable chamber;

a plurality of pressure sources; and a pressure switching assembly having an input connected to the plurality of pressure sources and an output coupled to the rotary union, the pressure switching assembly operable to couple a first pressure source of the plurality of pressure sources to a first pressure delivery channel and a second pressure source of the plurality of pressure sources to a second pressure delivery channel when in a first state, and operable to couple the second pressure source to the first pressure delivery channel and the first pressure source to the second pressure delivery channel when in a second state.

5. The polishing system of claim 4, wherein the pressure switching assembly is further operable to couple a third pressure source of the plurality of pressure sources to the first pressure delivery channel and the third pressure source to the second pressure delivery channel when in a third state.

6. The polishing system of claim 4, wherein the pressure switching assembly comprises a set of four or more valves.

7. The polishing system of claim 6, wherein the pressure switching assembly comprises a set of automatic valves coupled to a controller.

8. The polishing system of claim 7, wherein the set of valves comprises a number of valves equal to a product of a number of pressure sources multiplied by a number of pressurizable chambers.

9. The polishing system of claim 7, wherein the polishing assembly comprises between three and ten pressurizable chambers and between three and ten pressure delivery channels.

10. The polishing head of claim 1, wherein the plurality of pressurizable chambers comprises:

"n" single-pressure chambers, each single-pressure chamber coupled to a separate pressure delivery channel; and "n−1" dual-pressure chambers, each dual-pressure chamber separately coupled to two pressure delivery channels through two separate pressure feed lines, where "n" is an integer between two and twenty.

11. The polishing head of claim 10, wherein a dual-pressure chamber is adjacent to each single-pressure chamber.

12. The polishing head of claim 10, further comprising a manually movable plug interfaced with each pressure feed line.

13. The polishing head of claim 12, further comprising a separate opening through the housing for each manually movable plug, each opening enabling adjustment of a separate manually movable plug.

14. The polishing head of claim 12, wherein each manually movable plug comprises a threaded fastener.

15. The polishing head of claim 14, wherein each plug further comprises one or more sealing members.

16. The polishing head of claim 15, wherein n is four.

* * * * *